US006793532B2

(12) United States Patent
Saito et al.

(10) Patent No.: US 6,793,532 B2
(45) Date of Patent: Sep. 21, 2004

(54) SHIELD CONNECTION STRUCTURE

(75) Inventors: Satoshi Saito, Shizuoka (JP); Tomohiro Ikeda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/046,075

(22) Filed: Jan. 16, 2002

(65) Prior Publication Data

US 2002/0094724 A1 Jul. 18, 2002

(30) Foreign Application Priority Data

Jan. 17, 2001 (JP) ..... P2001-009438

(51) Int. Cl.[7] ..... H01R 9/03
(52) U.S. Cl. ..... 439/610; 439/98; 174/65 R
(58) Field of Search ..... 439/610, 559, 439/98, 92, 579, 585, 578, 583; 174/86, 84 R, 35 R, 35 C, 65 R, 51, 35

(56) References Cited

U.S. PATENT DOCUMENTS 5,691,506 A * 11/1997 Miyazaki et al. ..... 174/65

* cited by examiner

*Primary Examiner*—Alex Gilman
(74) *Attorney, Agent, or Firm*—Sughrue Mion, PLLC

(57) ABSTRACT

In a shield connection mechanism, a conductive shield member, which includes a plate member of a plate-like shape having a hole for passing a shielded wire therethrough, and a connection portion for connection to a shielding portion of the shielded wire, is contacted with and fixed to a casing of an equipment to be connected to the casing for grounding purposes and a reinforcing rib is formed on a peripheral edge portion of the shield member.

17 Claims, 3 Drawing Sheets

SHIELD CONNECTION STRUCTURE

CROSS REFERENCE TO RELATED APPLICATION

The present application is based on Japanese Patent Application No. 2001-9438, the entire contents of which are incorporated herein by reference.

BACKGROUND OF THE INVENTION

1. Field of the Invention

This invention relates to a shield connection structure in which a shielded wire is connected through a terminal to an equipment, such for example as a motor of an electric car, and a shielding portion of the shielded wire is connected to a casing of the equipment for grounding purposes.

2. Description of the Related Art

A conventional shield connection structure is shown in FIGS. 4 to 6.

In FIG. 4, a shielded wire 1 is subjected to an end processing, and is mounted on a casing 2 in such a manner that a shielding portion of the shielded wire 1 is connected to this casing for grounding purposes. As shown in FIG. 5, in this shielded wire 1, an insulating member 4 is coated on a conductor 3, and a braided wire 5, comprising conductor wires woven into a net-like structure, is provided on this insulating member 4, and a sheath 6 is provided on this braided wire 5 to cover the same. The structure of connecting the shielded wire 1 of this construction to the casing 2 is constructed as shown in FIGS. 5 and 6. Namely, an end portion of the shielded wire 1 is subjected to a processing, in which first, the sheath 6 is removed, thereby exposing the braided wire 5, and a distal end portion of this braided wire 5 is removed, and further the insulating member 4 is removed, thereby exposing the conductor 3.

A shield member 7 is attached to the thus end-processed shielded wire 1, and the braided wire 5 of this shielded wire 1 is connected to the shield member 7. This shield member 7 comprises an electrically-conductive plate member 8 having a plate-like shape, and this plate member 8 includes a larger-diameter portion 8A, through which a hole 9 for passing the shielded wire 1 therethrough is formed, and a smaller-diameter portion 8B having a hole 10 through which the shield member 7 can be screw-fastened to the casing 2. The shield member 7 has a tubular connection portion 11 formed on and projecting perpendicularly from an end portion of the hole 9 in the plate member 8.

The shielded wire 1 is fitted in the hole 9, formed through the larger-diameter portion 8A of the shield member 7, and an end of the connection portion 11 of the shield member 7 is disposed flush with the distal end of the sheath 6 as shown in FIG. 6, and the braided wire 5 of the shielded wire 1 is folded outwardly of the connecting portion 11 of the shield member 7, and is fitted on this connecting portion 11 of the shield member 7. A ring 12 is fitted on the braided wire 5 fitted on the connecting portion 11 of the shield member 7, and this ring 12 is compressively deformed, thereby fixedly securing the shield member 7 to the shielded wire 1. A terminal 13, having a ring-shaped distal end portion, is fixedly secured to that portion of the conductor 3 exposed at the distal end of the shielded wire 1. The shielded wire 1, thus subjected to the end processing, is mounted on the casing 2 by a screw (not shown) or the like passing through the hole 10 in the shield member 7, so that the braided wire 5 of the shielded wire 1 is electrically connected to the casing 2.

The plate member 8 of the shield member 7, used as an earth terminal for electrically connecting the braided wire 5 of the shielded wire 1 to the casing 2, is formed, for example, by a copper sheet having a thickness of 0.4 mm. Therefore, the plate member 8 of the shield member 7 can be easily bent with the force of the finger, and when fastening this plate member 8 to the casing 2 by tightening the screw, using the hole 10 in the shield member 7, the plate member 8 of the shield member 7 is deformed by a rotational force in a tightening direction and the friction. Therefore, for preventing the deformation during this screw tightening operation, there has been effected an operation in which a reinforcing member 14, having the same shape as that of the shield member 7, and having a considerable thickness, is mated with the rear side of the shield member 7, and in this condition the screw tightening is effected. A hole 15, formed through this reinforcing member 14, communicates with the hole 9 in the shield member 7, and a hole 16, formed through the reinforcing member 14, communicates with the hole 10 in the shield member 7.

Thus, the reinforcing member 14 is used when mounting the shield member 7 on the casing 2, and therefore in the conventional shield connection structure, the number of the component parts is large, and this is the cause for a failure to enhance the efficiency of the assembling operation.

SUMMARY OF THE INVENTION

It is an object of this invention to provide a shield connection structure in which the strength of a plate member of a shield member is enhanced, and the plate member can be prevented from deformation when it is screw-fastened to a casing, and the number of component parts of the shield connection structure, in which the shield member is screw-fastened to the casing, can be reduced, and the operation for mounting the shield member on the casing can be enhanced.

(1) In order to achieve the above object, there is provided a shield connection structure comprising a conductive shield member including a plate member having a hole in which a shielded wire is inserted, a connection portion for connecting to a shielding portion of the shielded wire, and a reinforcing rib formed on a peripheral edge portion of the shield member; wherein the shield member is fixed to a casing for grounding.

With this construction of the invention of (1), the strength of the plate member of the shield member is enhanced, and the plate member is prevented from deformation when screw-fastening this plate member to the casing, and the number of the component parts of the shield connection structure, in which the shield member is screw-fastened to the casing, can be reduced, and the operation for mounting the shield member on the casing can be enhanced.

(2) In order to achieve the above object, there is provided the shield connection structure of (1), in which the connection portion has a tubular shape, and is formed on and projects perpendicularly from an end portion of the hole for passing the shielded wire therethrough.

With this construction of the invention of (2), the shielded wire can be fitted into the connection portion of the shield member, and a braided wire of the shielded wire can be folded back to cover the connection portion of the shield member, so that the braided wire of the shielded wire can be positively electrically connected to the shield member.

(3) In order to achieve the above object, there is provided the shield connection structure of (1), in which the reinforcing rib is formed in a continuous manner on the peripheral edge portion of the shield member over an entire periphery thereof.

With this construction of the invention of (3), the shield member can have such a strength that the plate member will not be deformed when the shield member is fastened to the casing by a screw.

(4) In order to achieve the above object, there is provided the shield connection structure of (1), in which the reinforcing rib is integrally formed with the shielding member.

With this construction of the invention of (3), the number of components of the shield connection structure can be reduced. 5. A shield connection structure according to claim 1, wherein the shielding member and the reinforcing rib are constituted by one and the same component.

(5) As another aspect of the invention, there is provided a shield member fixed to a casing for grounding comprising a plate member having a hole; a connection portion having a tubular shape provided around the hole for supporting and connecting to a shielding portion of the shielded wire; and a reinforcing rib integrally formed on a peripheral edge portion of the shield member.

DETAILED DESCRIPTION OF THE PREFERRED EMBODIMENTS

A preferred embodiment of a shield connection structure of the present invention will now be described in detail with reference to the drawings.

Figure 1:
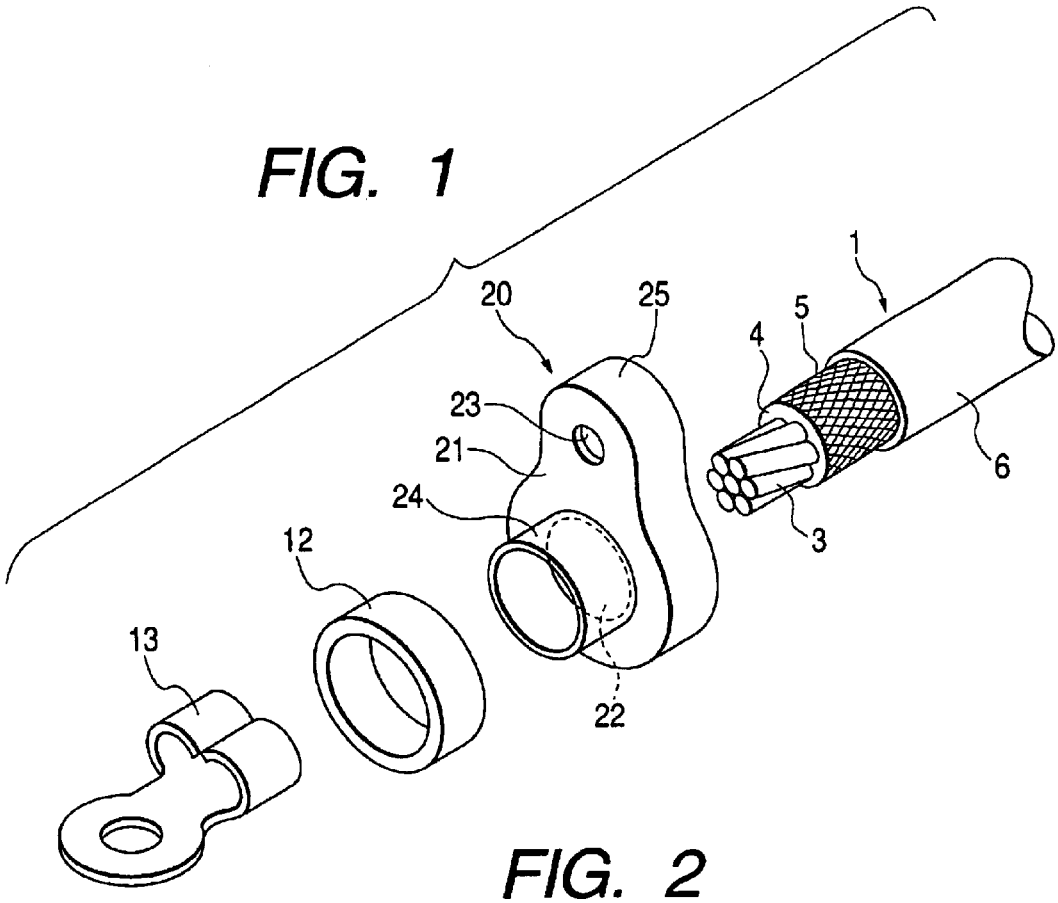
FIG. 1 is an exploded, perspective view showing a preferred embodiment of a shield connection structure of the present invention.
Figure 2:
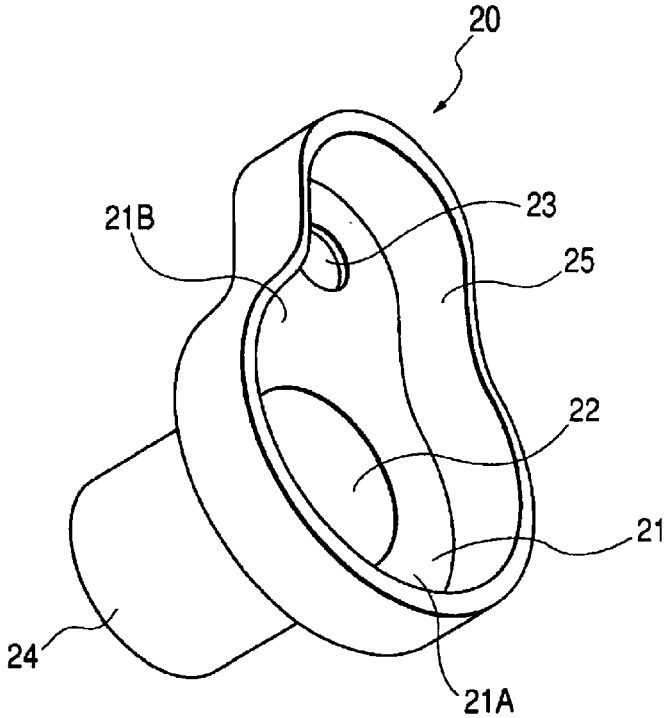
FIG. 2 is a perspective view of a shield member shown in FIG. 1.
Figure 3:
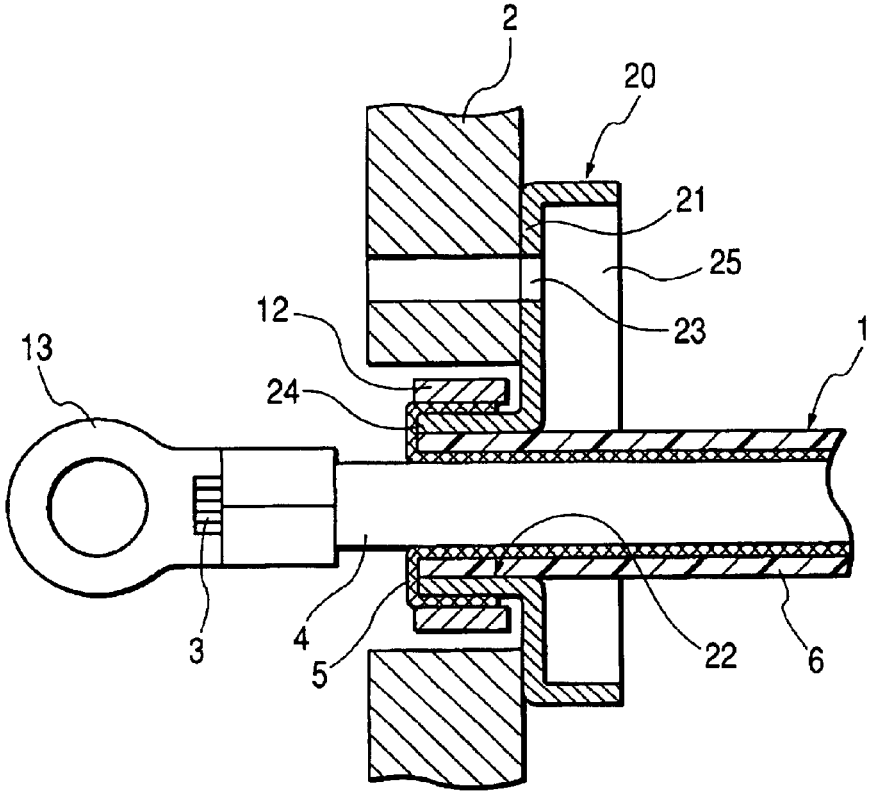
FIG. 3 is a cross-sectional view, showing a condition in which the shield member, shown in FIG. 2, is mounted on a casing.

FIG. 1 is an exploded, perspective view showing the construction of a shield member to which the present invention is applied, FIG. 2 is a perspective view of a plate member of the shield member used in the shield connection structure of the invention, and FIG. 3 is a cross-sectional view of the shield connection structure of the invention, showing a condition in which the shield member is mounted on a casing.

Figure 4:
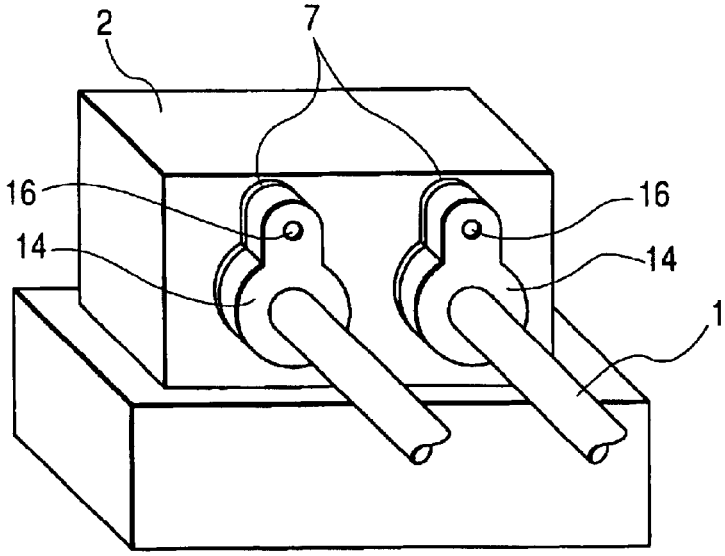
FIG. 4 is a perspective view, showing a condition in which a conventional shield member is mounted on a casing.
Figure 5:
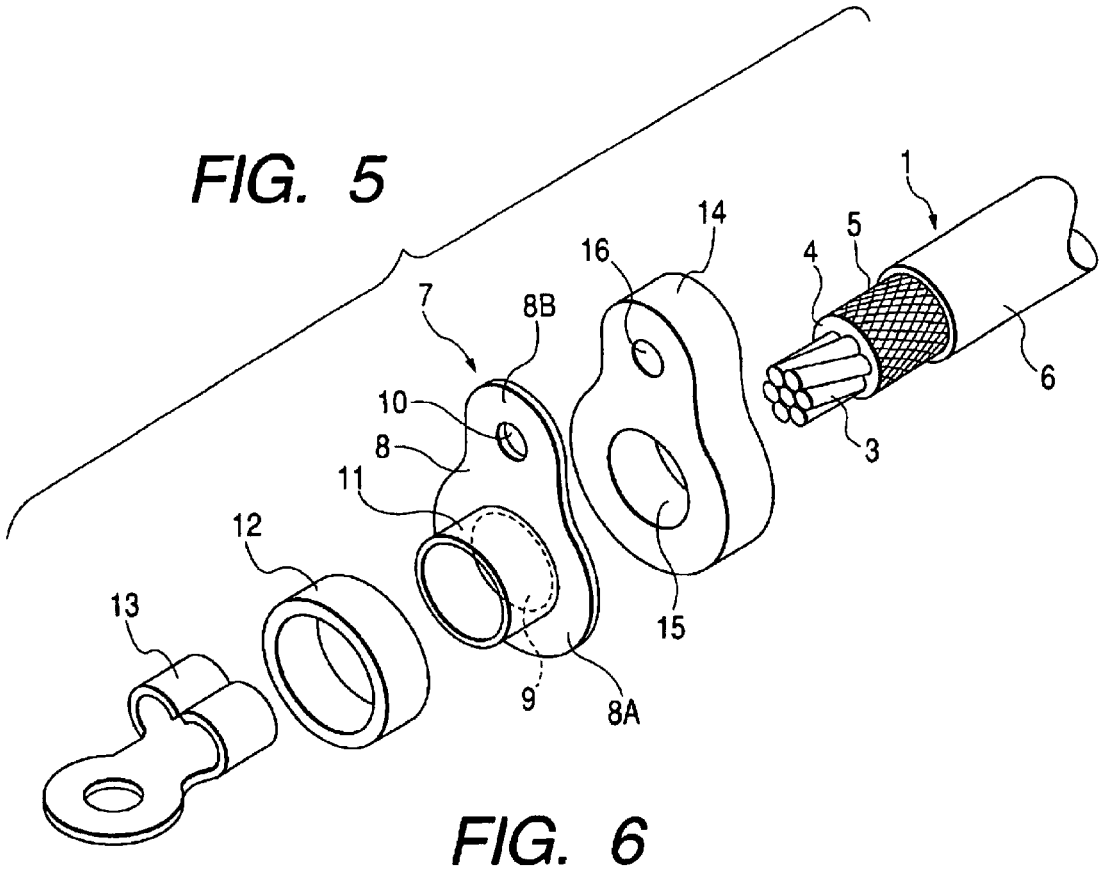
FIG. 5 is an exploded, perspective view of a conventional shield connection structure.
Figure 6:
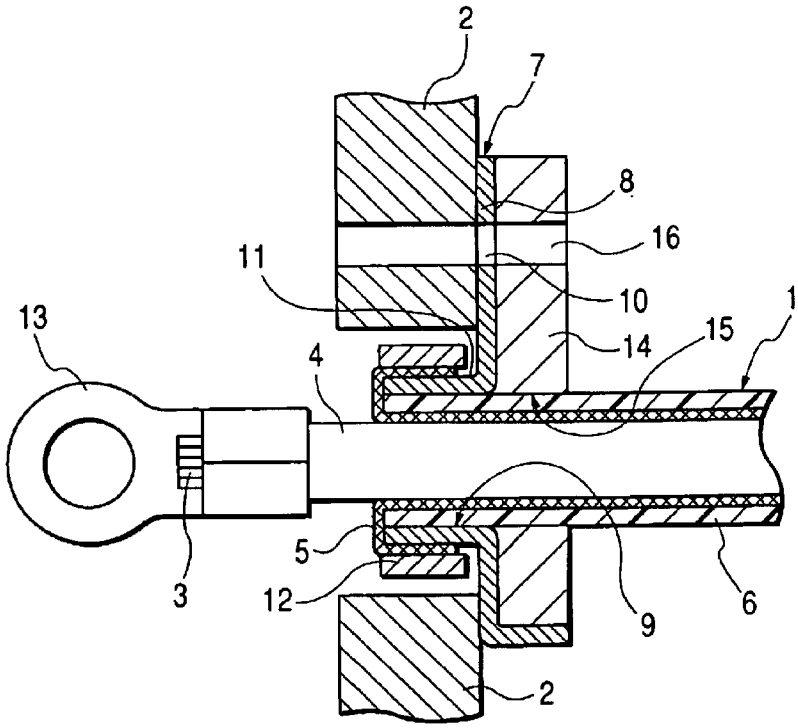
FIG. 6 is a cross-sectional view, showing a condition in which the shield member, shown in FIG. 5, is mounted on the casing 2.

In FIGS. 1 to 3, those members, identical to those of FIGS. 4 to 6, will be designated by identical reference numerals, respectively.

In FIG. 1, a shielded wire 1 is subjected to an end processing, and is mounted on the casing 2 in such a manner that a shielding portion of the shielded wire 1 is connected to this casing for grounding purposes. In this shielded wire 1, an insulating member 4 is coated on a conductor 3, and a braided wire 5, comprising conductor wires woven into a net-like structure, is provided on this insulating member 4, and a sheath 6 is provided on this braided wire 5 to cover the same. The structure of connecting the shielded wire 1 of this construction to the casing 2 is constructed as shown in FIGS. 2 and 3. Namely, an end portion of the shielded wire 1 is subjected to a processing, in which first, the sheath 6 is removed, thereby exposing the braided wire 5, and a distal end portion of this braided wire 5 is removed, and further the insulating member 4 is removed, thereby exposing the conductor 3.

The shield member 20 is attached to the thus end-processed shielded wire 1, and the braided wire 5 of this shielded wire 1 is connected to the shield member 20. As shown in FIG. 2, this shield member 20 comprises the electrically-conductive plate member 21 having a plate-like shape, and this plate member 21 includes a larger-diameter portion 21A, through which a hole 22 for passing the shielded wire 1 therethrough is formed, and a smaller-diameter portion 21B having a hole 23 through which the shield member 20 can be screw-fastened to the casing 2. The shield member 20 has a tubular connection portion 24 formed on and projecting perpendicularly from an end portion of the hole 22 in the plate member 21. Further, a reinforcing rib 25 of a predetermined height is formed on a peripheral edge portion of this plate member 21. In this embodiment, although this reinforcing rib 25 is formed on the peripheral edge portion of the plate member 21 over the entire periphery thereof, it does not always need to be formed on the peripheral edge portion of the plate member 21 over the entire periphery thereof, but may be provided in the form of comb teeth, or may be provided in such a manner that it interconnects points on the peripheral edge portion.

The shielded wire 1 is fitted in the hole 22, formed through the larger-diameter portion 21A of this shield member 20, and an end of the connection portion 24 of the shield member 20 is disposed flush with the distal end of the sheath 6 as shown in FIG. 3, and the braided wire 5 of the shielded wire 1 is folded outwardly of the connecting portion 24 of the shield member 20, and is fitted on this connecting portion 24 of the shield member 20. A ring 12 is fitted on the braided wire 5 fitted on the connecting portion 24 of the shield member 20, and this ring 12 is compressively deformed, thereby fixedly securing the shield member 20 to the shielded wire 1. A terminal 13, having a ring-shaped distal end portion, is fixedly secured to that portion of the conductor 3 exposed at the distal end of the shielded wire 1. The shielded wire 1, thus subjected to the end processing, is mounted on the casing 2 by a screw (not shown) or the like passing through the hole 23 in the shield member 20, so that the braided wire 5 of the shielded wire 1 is electrically connected to the casing 2.

Thus, the reinforcing rib 25 of the predetermined height is formed on the peripheral edge portion of the plate member 21 of the shield member 20, and therefore when fastening this shield member to the casing 2 by tightening the screw, using the hole 23 in the shield member 20, the plate member 21 of the shield member 20 will not be deformed even when a rotational force is applied in a tightening direction to produce a friction between the plate member 21 and the casing 2. Therefore, it is not necessary to effect the conventional operation, in which the reinforcing member 14 is mated with the rear side of the shield member 7, and in this condition the screw tightening is effected. Therefore, the number of the component parts is reduced, and the mounting operation can be easily effected.

The present application provides the above-mentioned construction, and therefore the following advantageous effects can be achieved.

In the shield connection structure of the present invention, the strength of the plate member of the shield member is enhanced, and the plate member is prevented from deformation when screw-fastening this plate member to the casing, and the number of the component parts of the shield connection structure, in which the shield member is screw-fastened to the casing, can be reduced, and the operation for mounting the shield member on the casing can be enhanced.

In the shield connection structure of the present invention, the shielded wire can be fitted into the connection portion of the shield member, and the braided wire of the shielded wire can be folded back to cover the connection portion of the shield member, so that the braided wire of the shielded wire can be positively electrically connected to the shield member.

In the shield connection structure of the present invention, the shield member can have such a strength that the plate member will not be deformed when the shield member is fastened to the casing by the screw.

What is claimed is:

1. A shield connection structure comprising:

a conductive shield member comprising:

a plate member having a hole in which a shielded wire is inserted;

a connection portion for connecting to a shielding portion of the shielded wire; and a reinforcing rib formed on a peripheral edge portion of said shield member, wherein:

said shield member is fixed to a casing for grounding;

said reinforcing rib and said shield member are formed of a one-piece construction; and said shielded wire includes a braided wire and said connection portion is dimensioned to support said braided wire folded over the exterior of the connection portion.

2. A shield connection structure according to claim 1, wherein said connection portion has a tubular shape, and is formed on and projects perpendicularly from an end portion of said hole for passing said shielded wire therethrough.

3. A shield connection structure according to claim 1, wherein said reinforcing rib is formed in a continuous manner on the peripheral edge portion of said shield member over an entire periphery thereof.

4. A shield connection structure according to claim 1, wherein said shielding member and said reinforcing rib are constituted by one and the same component.

5. A shield connection structure according to claim 1, further comprising a ring which is fitted on the exterior of said braided wire.

6. A shield member fixed to a casing for grounding comprising:

a plate member having a hole;

a connection portion having a tubular shape provided around the hole for supporting and connecting to a shielding portion of a shielded wire; and a reinforcing rib integrally formed on a peripheral edge portion of said shield member, wherein:

said reinforcing rib and said shield member are formed of a one-piece construction; and said shielded wire includes a braided wire and said connection portion is dimensioned to support said braided wire folded over the exterior of the connection portion.

7. A shield connection structure according to claim 6, further comprising a ring which is fitted on the exterior of said braided wire.

8. A shield connection structure comprising:

a conductive shield member comprising:

a plate member having a hole in which a shielded wire is inserted;

a connection portion provided to contact a shielding portion of the shielded wire; and a reinforcing rib formed on a peripheral edge portion of said shield member, wherein said shield member is fixed to a casing for grounding; and said reinforcing rib, said connection portion and said shield member are formed of a one-piece construction.

9. A shield connection structure according to claim 8, wherein said connection portion has a tubular shape, and is formed on and projects perpendicularly from an end portion of said hole for passing said shielded wire therethrough.

10. A shield connection structure according to claim 8, wherein said reinforcing rib is formed in a continuous manner on the peripheral edge portion of said shield member over an entire periphery thereof.

11. A shield connection structure according to claim 8, wherein said shielding member and said reinforcing rib are constituted by one and the same component.

12. A shield member fixed to a casing for grounding comprising:

a plate member having a hole;

a connection portion having a tubular shape provided around the hole to support and contact a shielding portion of a shielded wire; and a reinforcing rib provided on a peripheral edge portion of said shield member, wherein said reinforcing rib, said connection portion and said shield member are formed of a one-piece construction.

13. A shield connection structure comprising:

a conductive shield member comprising:

a plate member having a hole in which a shielded wire is inserted;

a connection portion for contacting a shielding portion of the shielded wire; and a reinforcing rib formed on a peripheral edge portion of said shield member; wherein:

said shield member is fixed to a casing for grounding;

said reinforcing rib and said shield member are formed of a one-piece construction; and said reinforcing rib and said connection portion extend in opposite directions from said plate member, and are located only on opposite sides of said plate member.

14. A shield connection structure according to claim 13, wherein said connection portion has a tubular shape, and is formed on and projects perpendicularly from an end portion of said hole for passing said shielded wire therethrough.

15. A shield connection structure according to claim 13, wherein said reinforcing rib is formed in a continuous manner on the peripheral edge portion of said shield member over an entire periphery thereof.

16. A shield connection structure according to claim 13, wherein said shielding member and said reinforcing rib are constituted by one and the same component.

17. A shield member fixed to a casing for grounding comprising:

a plate member having a hole;

a connection portion having a tubular shape provided around the hole for supporting and contacting a shielding portion of a shielded wire; and a reinforcing rib provided on a peripheral edge portion of said shield member, wherein:

said reinforcing rib and said shield member are formed of a one-piece construction; and said reinforcing rib and said connection portion extend in opposite directions from said plate member, and are located only on opposite sides of said plate member.

* * * * *